US005791711A

United States Patent [19]

Tobias

[11] Patent Number: 5,791,711

[45] Date of Patent: Aug. 11, 1998

[54] PALLET PULLER

[76] Inventor: Stewart W. Tobias, 1611 18th Avenue Dr. East, Palmetto, Fla. 34221-6503

[21] Appl. No.: 929,145

[22] Filed: Sep. 10, 1997

[51] Int. Cl.[6] ..... B66C 1/62

[52] U.S. Cl. ..... 294/82.1

[58] Field of Search ..... 294/12, 15, 26, 294/27.1, 67.3, 81.53, 82.1, 82.11, 86.4, 89; 280/24, 480

[56] References Cited

U.S. PATENT DOCUMENTS

| | | | |
|---|---|---|---|
| 1,381,761 | 6/1921 | Stansbury et al. | 294/82.1 |
| 1,427,214 | 8/1922 | Lightner et al. | 294/82.1 |
| 3,073,613 | 1/1963 | Bergstrom | 294/82.1 X |
| 3,727,966 | 4/1973 | Stockwell | 294/82.1 |
| 4,094,544 | 6/1978 | Spaine | 294/82.1 |
| 4,421,353 | 12/1983 | Smith | 294/82.1 |
| 4,841,880 | 6/1989 | Ferguson | 294/82.1 X |
| 4,955,647 | 9/1990 | Alfredson | 294/26 X |

*Primary Examiner*—Johnny D. Cherry
*Attorney, Agent, or Firm*—Charles J. Prescott

[57] ABSTRACT

A pallet puller for secure engagement with a cargo pallet whereby the pallet may be slidingly pulled as in off-loading a cargo truck. The device is formed of a single length of preferably cylindrical rod material defining a main rod member having a pulling loop or ring formed into an outer end thereof which facilitates connection to a pulling apparatus such as a forklift truck or power winch. The inner end is formed having a fist orthogonal bend leading to a first segment or portion which extends orthogonally from the first bend and the rod member, then a second bend leading to a second segment or portion which is orthogonal to both the first segment and the longitudinal axis of the rod member. This structure effects quick, positive, non-damaging engagement against an edge of one foot board of the pallet and beneath one stringer of the pallet to insure non-slipping pallet engagement.

3 Claims, 2 Drawing Sheets

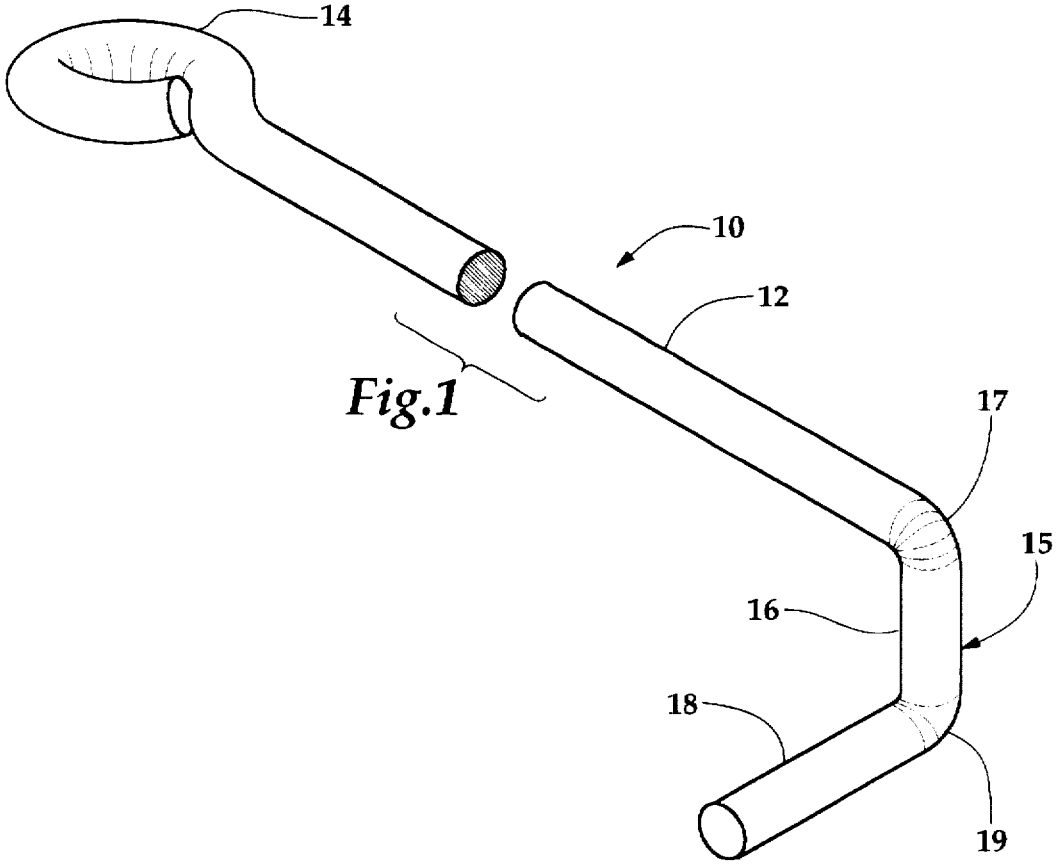
Fig.1
Fig.2
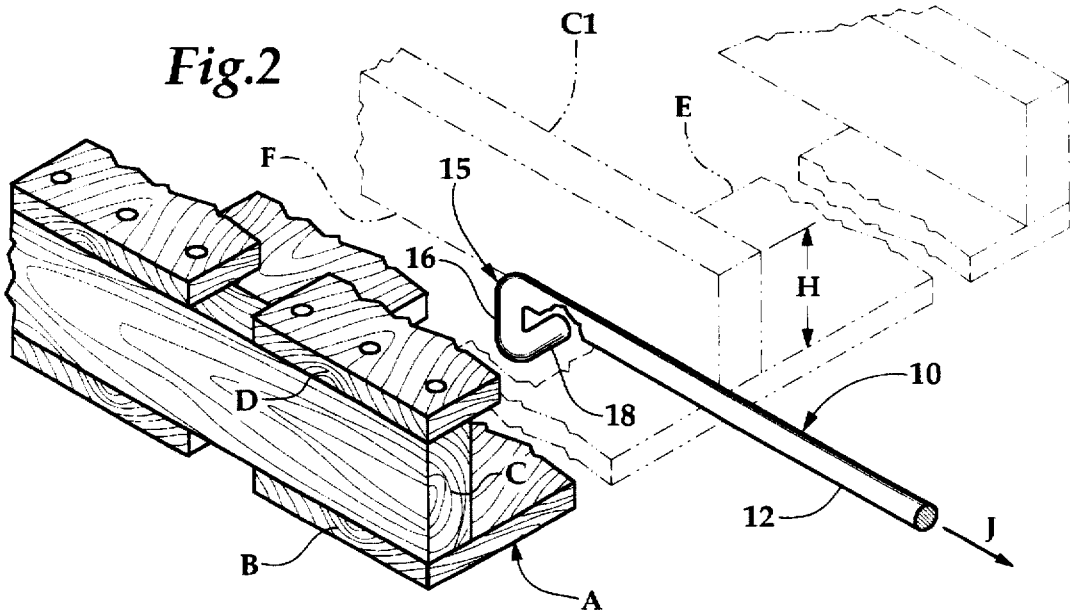

PALLET PULLER

BACKGROUND OF THE INVENTION

1. Scope of Invention

This invention relates generally to devices for off-loading cargo pallets, and more particularly to a simple device for quick, non-destructive engagement of cargo pallets for slideable off-loading or movement thereof.

2. Prior Art

Off-loading of pallets bearing cargo from the bed of a truck is typically done in two stages. First, each pallet is slid to the rear edge of the truck bed, after which a forklift truck is typically utilized to lift and carry each loaded cargo pallet into a warehouse or the like.

Due to the weight of the cargo pallet and the irregular surface of truck trailer beds, a substantial pulling force is required, thus requiring a very positive engagement with the pallet which is typically fabricated of wood board segments.

A number of prior art devices known to applicant have been provided for this purpose, the majority of which are complex, ineffective for reliable pallet engagement, and/or may damage the reusable wooden structure of the pallet during sliding movement thereof.

One such device is disclosed in U.S. Pat. No. 4,421,353 invented by Smith which teaches, in one form, two pivotally mounted arms having cross pieces that fit beneath the stringer of the pallets and engage against one of the edges of one floorboard. In another embodiment, a single elongated arm of this device with a cross piece on the end thereof is also provided.

A freight skid tow bar for pallet sliding is taught by Stockwell in U.S. Pat. No. 3,727,966. The Stockwell device provides a tow bar comprising an elongated strap iron which has a clevice type hook at one end and a downwardly turned book portion at the opposite end structured for biting engagement with the wooden pallet. This device appears likely to damage the wooden pallet structure over time and does not seem to have sufficient locking engagement to prevent inadvertent disengagement during towing.

Another pallet puller device shown in U.S. Pat. No. 4,094,544 invented by Spaine comprises a wide face generally elongated L-shaped hook member formed of plate metal stock having a right angle bent flange at the inner end thereof designed for cooperative engagement with one of the foot boards or load bearing boards of the pallet. However, this device also appears to be susceptible to inadvertent disengagement during the towing process.

A pallet coupler invented by Bergstrom as disclosed in U.S. Pat. No. 3,073,613 appears to be a more complex weldment having two spaced elongated members connected to a central plate, the distal ends of these elongated members each having downwardly extending flanges welded thereto. These flanges are adapted to engage against one edge of a foot board of a pallet which engagement is again somewhat unstable and likely would lead to inadvertent disengagement during towing of the pallet.

To demonstrate the wide range of devices an apparatus for accomplishing this important frequently repeated, everyday task in cargo transfer, the following U.S. Patents are also known to applicant which are somewhat more removed from the present invention than those above described:

| | |
|---|---|
| U.S. Pat. No. 1,422,228 | Shaffer |
| U.S. Pat. No. 290,785 | Millard |
| U.S. Pat. No. 62,309 | Beard |
| U.S. Pat. No. 3,761,121 | Reid |
| U.S. Pat. No. 4,114,941 | Heaton |
| U.S. Pat. No. 3,616,952 | Aguilar |
| U.S. Pat. No. 4,869,540 | Faul |
| U.S. Pat. No. 3,452,963 | Holst, Sr. |
| U.S. Pat. No. 3,807,786 | Alegria |
| U.S. Pat. No. 4,262,952 | Bradley |
| U.S. Pat. No. 4,629,238 | Woodruff |
| U.S. Pat. No. 2,420,001 | McCollum |

The present invention provides a device for pulling loaded cargo pallets which might be considered to be of utmost simplicity and yet still afford all of the strength and reliable grasping retention required to avoid any inadvertent disengagement from a pallet while being pulled and further avoids any damage to these reusable wooden pallets.

BRIEF SUMMARY OF THE INVENTION

This invention is directed to a pallet puller for secure engagement with a cargo pallet whereby the pallet may be slidingly pulled as in off-loading a cargo truck. The device is formed of a single length of preferably cylindrical rod material defining a main rod member having a pulling loop or ring formed into an outer end thereof which facilitates connection to a pulling apparatus such as a forklift truck or power winch. The inner end is formed having a fist orthogonal bend leading to a first segment or portion which extends orthogonally from the first bend and the rod member, then a second bend leading to a second segment or portion which is orthogonal to both the first segment and the longitudinal axis of the rod member. This structure effects quick, positive, non-damaging engagement against an edge of one foot board of the pallet and beneath one stringer of the pallet to insure non-slipping pallet engagement.

It is therefore an object of this invention to provide a pallet puller which is economical to manufacture and which provides quick, positive non-slipping engagement with cargo pallets for sliding and off-loading of loaded cargo pallets from the bed of a truck.

It is another object of this invention to provide a pallet puller which has virtually no tendency toward inadvertent disengagement during pallet pulling.

It is yet another object of this invention to provide a pallet puller which positively engages a portion of a wooden pallet without causing any undue damage thereto while being used to pull loaded cargo pallets along the bed of a truck or other similar circumstances.

In accordance with these and other objects which will become apparent hereinafter, the instant invention will now be described with reference to the accompanying drawings.

BRIEF DESCRIPTION OF THE DRAWINGS

FIG. 1 is a broken perspective of the invention.

FIG. 2 is a perspective view of the invention of FIG. 1 shown in an in-use position with respect to a cargo pallet shown fragmented and partially in phantom.

DETAILED DESCRIPTION OF THE INVENTION

Figure 3:
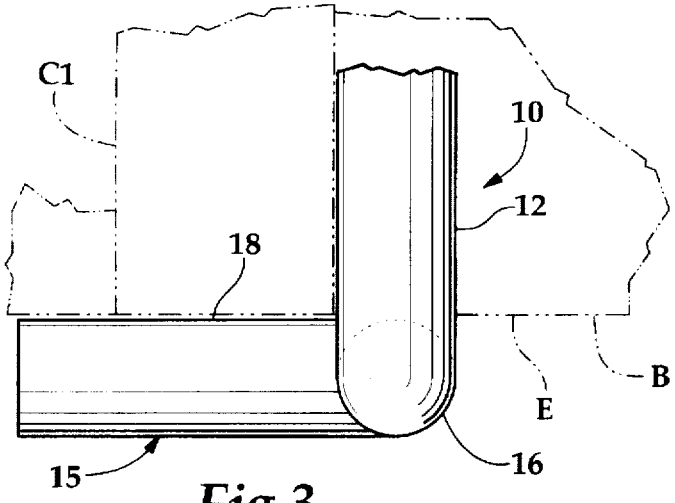
FIG. 3 is a top plan view of the inner end portion of the invention of FIG. 1 in an in-use position with respect to a cargo pallet shown fragmented in phantom.

Referring now to the drawings, the invention is shown generally at numeral 10 and is fabricated of a single preferably solid steel cylindrical rod of uniform diameter resulting in a generally straight main rod member 12 elongated in length sufficiently to perform the functions described here below. Formed at an outer end of the rod member 12 is a pulling loop or ring 14 defining a central aperture which is engageable with an apparatus for pulling such as a forklift truck or a power winch.

An inner end 15 of the device 10 is formed for pallet engagement by forming a first generally 90° or orthogonal bend 17 which defines a first inner end segment 16 and a second generally orthogonal bend 19 which defines a distal or second inner end portion 18. The first inner end portion 16 is preferably shorter in straight length than that of the second inner end portion 18 for greater surface engagement against an edge E of a foot board B described more fully herebelow.

Figure 4:
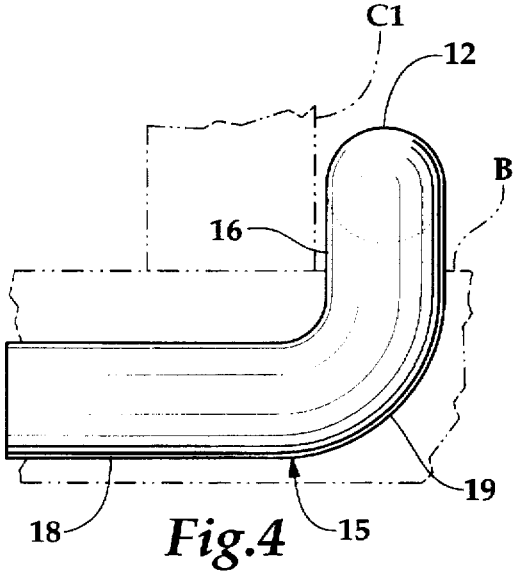
FIG. 4 is a front end elevation view of FIG. 3.
Figure 5:
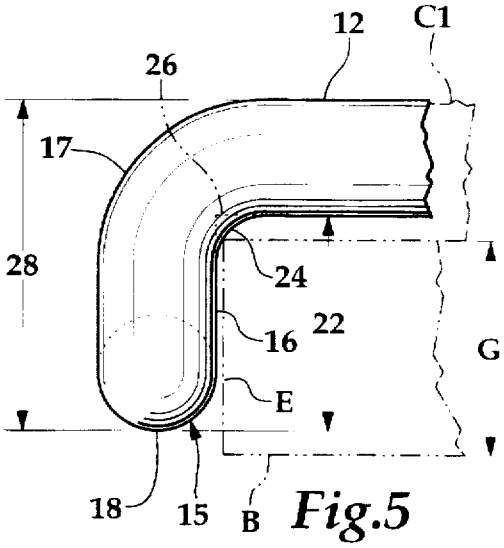
FIG. 5 is a right side elevation view of FIG. 3.

A conventional cargo pallet is shown in FIG. 2 at A and in fragmented phantom in FIGS. 3, 4 and 5 which generally is constructed of wooden boards. Each pallet A includes a plurality of spaced, parallel foot boards B held together by transversely oriented spaced apart parallel stringers C. Finally, a plurality of spaced apart load bearing boards D are attached as by nailing or screws atop the upper edge of each of the stringers C having a width H which defines the gap available for introducing the present invention 10.

The invention 10 utilizes the strength of the edge E of one of the foot boards B against which the second inner end portion 18 bears during pulling of the pallet A in the direction of the arrow J shown in FIG. 2. However, the device 10 goes further than simply providing a transverse portion 18 for pressing engagement against the edge E of one foot board B by the unique arrangement of first and second orthogonally formed portions 16 and 18 of the inner end 15. By providing the first downwardly extending portion 16, the second or distal portion 18 is not only positioned against the edge E of one foot board B, but is also trapped beneath one stringer C1 to prevent any tendency of the inner end 15 from any lifting inadvertent disengagement during pallet pulling.

To accomplish this self-locking arrangement, the distance 22 between the lower surface of rod member 12 and the lower surface of the second portion 18 seen in FIG. 5 should preferably be maintained at a distance no greater than the thickness G of the foot board B and preferably in close proximity thereto. A further dimensional size limitation with respect to the diameter of the rod material as best seen in FIG. 5 is that it cannot be any larger than the thickness G of the foot board B. Otherwise, insertion of the second portion 18 beneath the stringer C1 would be impossible without lifting of the pallet A. A still further, perhaps obvious dimensional limitation of the present invention is that the overall height 28 seen in FIG. 5 cannot be substantially greater than clearance height H between the foot boards B and the load bearing boards D.

Note that the first bend 17 as seen in FIG. 5 has a very tight inner radius at 24 so as to minimize any distortion of the corresponding edge of the foot board B and to also minimize the resulting clearance between the lower surface of rod member 12 and the upper surface of foot board B as pulling pressure is applied against edge E. Thus, it may be helpful to machine a square notch 26 into this bend 17 at 24 to minimize this brief riding up effect during initial pulling of each pallet.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A pallet puller for quickly engaging a pallet of the type that includes a plurality of spaced foot boards each having a given thickness and an upper surface, a plurality of spaced stringers each extending transversely and secured to said foot boards, each said stringer having a lower surface that abuts the planar upper surfaces of said foot boards, and a plurality of spaced load supporting boards mounted on the upper planar edges of said stringers opposite said foot boards, said pallet puller comprising:

an elongated slender rigid unitary rod member having an inner end and an outer end, said outer end adapted for connection to said rod member;

said inner end formed having a first portion extending generally orthogonally from said rod member and a distal generally straight second portion extending generally orthogonally from said first portion and oriented generally orthogonally to a longitudinal axis of said rod member;

a lower surface of said second portion spaced below and from a lower surface of said rod member near said first portion a maximum distance not exceeding the given thickness of said foot boards.

2. A pallet puller as set forth in claim 1, wherein:

said rod member is formed of cylindrical rod material having a uniform diameter along substantially an entire length thereof, said uniform diameter being substantially less than the given thickness of said foot boards.

3. A pallet puller as set forth in claim 2, wherein:

said lower surface of said second portion is spaced from an upper surface of said rod member a maximum distance not exceeding a height of said stringers which defines a space between said foot boards and said load supporting boards.

* * * * *